United States Patent [19]

Katayama et al.

[11] Patent Number: 5,072,711

[45] Date of Patent: Dec. 17, 1991

[54] FUEL INJECTION CONTROL SYSTEM FOR AUTOMOTIVE ENGINE

[75] Inventors: Kenji Katayama; Seiji Yashiki, both of Hiroshima, Japan

[73] Assignee: Mazda Motor Corporation, Hiroshima, Japan

[21] Appl. No.: 589,918

[22] Filed: Sep. 26, 1990

[30] Foreign Application Priority Data

Sep. 27, 1989 [JP] Japan ..... 1-253086

[51] Int. Cl.[5] ..... F02D 41/04

[52] U.S. Cl. ..... 123/486; 123/480

[58] Field of Search ..... 123/357, 358, 359, 380, 123/478, 480, 486, 494; 74/857

[56] References Cited

U.S. PATENT DOCUMENTS

| | | | |
|---|---|---|---|
| 4,313,412 | 2/1982 | Hosaka et al. | 123/480 |
| 4,376,428 | 3/1983 | Hata et al. | 123/417 |
| 4,561,404 | 12/1985 | Kanno et al. | 123/492 |
| 4,665,878 | 5/1987 | Takeuchi et al. | 123/492 |
| 4,683,860 | 8/1987 | Shimamura et al. | 123/492 |
| 4,819,777 | 4/1989 | Yasue et al. | 74/857 |
| 4,829,439 | 5/1989 | Otobe | 123/179 R |
| 4,844,039 | 7/1989 | Osaki et al. | 123/480 |
| 4,848,303 | 7/1989 | Fujimoto et al. | 123/480 |
| 4,892,078 | 1/1990 | Fukutomi et al. | 123/492 |
| 4,938,197 | 7/1990 | Kido et al. | 123/492 |

*Primary Examiner*—E. Rollins Cross
*Assistant Examiner*—Tom Moulis
*Attorney, Agent, or Firm*—Fleit, Jacobson, Cohn, Price, Holman & Stern

[57] ABSTRACT

A fuel injection control system is designed to be commonly available to an engine with a manual transmission and an engine with an automatic transmission. The internal combustion engine has a fuel injection device for delivering different amounts of fuel to the engine according to engine operating conditions. The fuel injection control system causes the fuel injection device to make an increase in fuel amount when the engine operates in a specific zone of engine operating conditions defined by engine operating speeds and loads. When the engine operating condition remains in the specific zone, the control system makes the increase in fuel amount with a time delay from a time the engine operating condition changes into the specific zone. The specific zone, when the engine is equipped with an automatic transmission, is expanded toward a side of engine speeds higher than an engine speed by which an upper extreme engine speed of the specific zone is defined that when the engine operates in the expanded part of the specific range and at high elevations, the system intentionally causes an increase in fuel.

14 Claims, 5 Drawing Sheets

| |
|---|
| FIG. 2A |
| FIG. 2B |

FUEL INJECTION CONTROL SYSTEM FOR AUTOMOTIVE ENGINE

FIELD OF THE INVENTION

This invention relates to a fuel control system for an engine, more particularly, a fuel injection control system for an automotive internal combustion engine for intentionally increasing the amount of fuel to be delivered to the engine.

BACKGROUND OF THE INVENTION

Automobile engine fuel injection control systems which determine the proper air-fuel ratio and constantly monitor the exhaust gas to verify the accuracy of the air-fuel ratio mixture setting are known. Typically, such fuel injection control systems have a facility for intentionally increasing fuel delivery. The intentionally increased fuel delivery is typically effected, when an engine operating condition has fallen into a specific zone of high power engine demand or high engine load, so as to intentionally increase the amount of fuel delivered to the engine and provide the desired, or sufficiently, high engine output power. One such fuel injection control systems is disclosed, for example, in Japanese Unexamined Patent Publication No. 53 - 8427.

In the fuel injection control system described in the above publication, if the engine quickly changes its operating condition into another zone in which engine loads are still high but lower than in the specific zone, and engine speeds are moderated, from the specific zone, the intentionally increased fuel delivery is temporarily suspended. However, the fuel injection control system, if the engine continues to operate in said another zone for a certain period of time, allows the intentionally increased fuel delivery to be re-instated after the lapse of the certain time period. Such a feature of the fuel injection control system is referred to as delayed fuel increase control.

The fuel injection control system, if used for an engine equipped with an automatic transmission, is required in order for the engine to provide the same engine output power as an engine equipped with a manual transmission, to force the engine to operate at a speed higher than the speed at which the engine with the manual transmission operates to provide the same engine output power. This is because the automatic transmission, particularly the torque converter, allows some slippage, thereby sacrificing some of the torque transmitted from the engine. For this reason, the fuel injection control system, when the engine load is increased forces the engine to change its speed directly to one falling in the specific zone for intentionally increased fuel delivery (hereinafter referred to the fuel increase control zone) without transitionally falling into the other zone for delayed fuel increase control (which is hereinafter referred to as the delayed fuel increase control zone). Accordingly, the fuel injection control system, even when the engine operating condition changes to one falling in the delayed fuel increasing control zone, immediately after having been retained in the fuel increase control zone, unavoidably makes an increase in the fuel amount for a short time period while the engine operates at an operating condition in the fuel increase control zone, as to deliver or provide the engine with excess fuel. Particularly, during a kick down condition when fully depressing an accelerator pedal as to open the throttle valve to near its full-open position, the engine is delivered with a considerably excessive amount of fuel.

SUMMARY OF THE INVENTION

A primary object of the present invention is to provide a fuel injection control system for an internal combustion engine which intentionally increases the amount of fuel delivered to the engine when the engine operates under specific conditions.

Another object of the invention is to provide a fuel injection control system as above which can be used with an engine equipped with either a manual or an automatic transmissions.

These objects are accomplished by providing a fuel injection control system having fuel injection means for delivering different amounts of fuel according to engine operating conditions. The fuel injection control system includes fuel increasing means for causing the fuel injection means to increase the amount of fuel to be delivered into the engine when the engine operates in a specific zone of engine operating conditions defined by engine operating speeds and loads and control means for forcing, the fuel increasing means to make the increase in fuel after a predetermined time after the engine operating condition changes to said specific zone. The specific zone, when an automatic transmission is used, is expanded to engine speeds higher than an engine speed defining an upper extreme engine speed of the specific zone, so that the fuel increasing means, when the engine operates in the expanded or additional part of the specific zone, causes the fuel injection means to make the increase in fuel. The predetermined delay time is made shorter in the expanded or additional part of the specific zone than in the specific zone.

When depressing the accelerator pedal deeply as to compensate for slippage of the torque converter of the automatic transmission, the engine increases its speed. Accordingly, the engine load increases while the engine maintains the increased engine speed. If the engine operating condition changes to moderate engine loads or low engine loads after a short time period within the expanded part of the specific zone, no increase in fuel amount is made even though the engine operating condition is temporarily retained within the expanded part of the specific zone.

BRIEF DESCRIPTION OF THE DRAWINGS

The above and other objects and features of the present invention will be apparent from the following description of a preferred embodiment thereof when considered in conjunction with the appended drawings, in which.

DETAILED DESCRIPTION OF THE PREFERRED EMBODIMENT

Because in general automobile engines are well known, the present description will be directed particularly to elements forming parts of, or in cooperation directly with, the system in accordance with the present invention. It is to be understood that elements not specifically shown or described can take various forms well known to those skilled in the automobile art.

Figure 1:
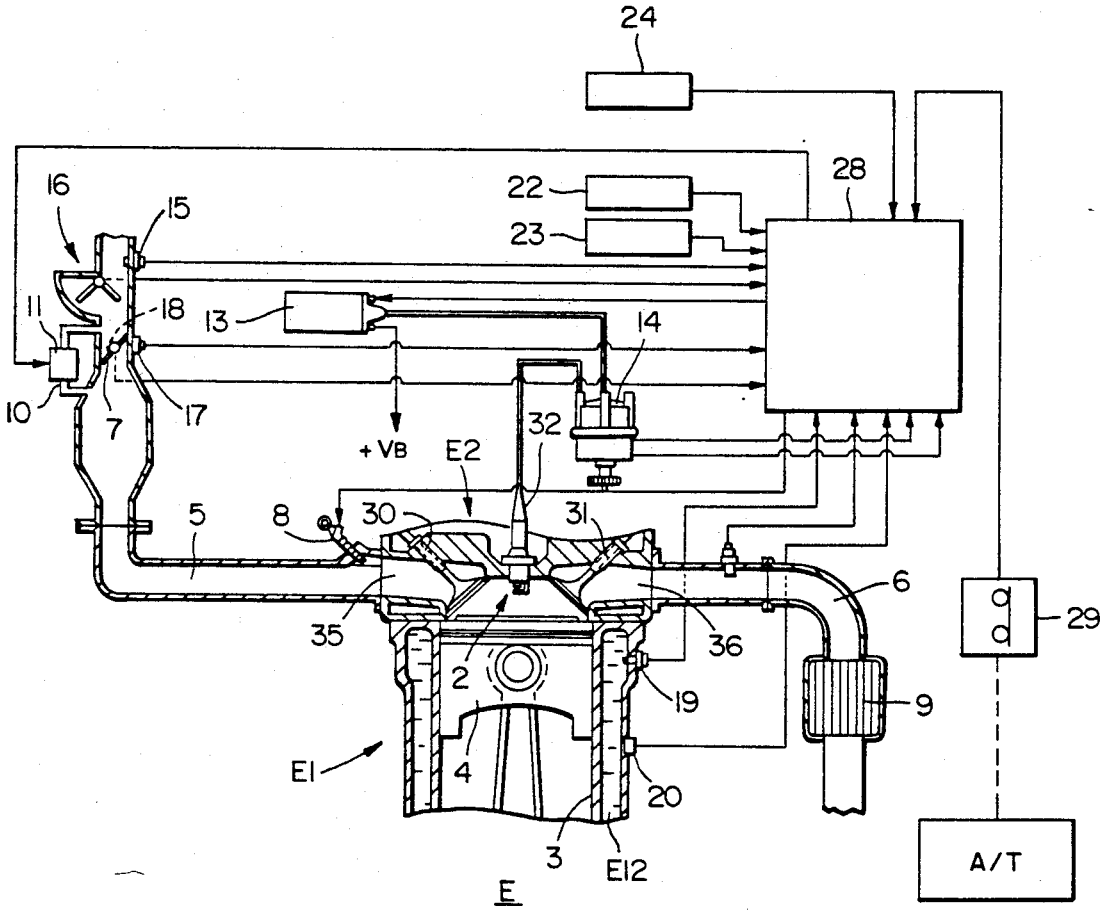
FIG. 1 is a schematic illustration showing an internal combustion engine with a fuel injection control system in accordance with a preferred embodiment of the present invention.

Referring to the drawings in detail, and particularly to FIG. 1, there is shown an internal combustion engine with a fuel injection control system, for controlling air-fuel ratio, in accordance with a preferred embodiment of the present invention. The engine E has an cylinder block El, shown partly cut away, formed with a cylinder bores 3 in which pistons 4 can slide. Combustion chambers 2 are formed between and variably defined by the respective cylinder bores 3 and pistons 4. A cylinder head E2, shown partly cut away, is mounted on the cylinder block El and is formed with intake and exhaust ports 35 and 36, each opening into respective combustion chambers 2. In the cylinder head E2 are disposed or installed intake and exhaust valves 30 and 31 seated in the intake and exhaust ports 35 and 36, respectively. The intake and exhaust valves 30 and 31 are timely or sequentially driven by a valve train (which can be of any type well known in the art and, accordingly, not shown in FIG. 1 for simplicity) to open and close the intake and exhaust valves 30 and 31. A spark plug 32 is threaded into the cylinder head E2 at the top of the combustion chamber 2. The spark plug 32, cooperating with an ignition coil 13 and a distributor 14, constitutes a firing system well known in the art. The distributor 14 has the function of recognizing a reference cylinder, and the function of detecting the speed of rotation of the engine E and sending a signal, representative of the engine speed detected thereby, to the controller 28.

The combustion chamber 2 is in communication with intake and exhaust manifolds 5 and 6, respective ends of which are connected to the intake and exhaust ports 35 and 36. The intake manifold 5 is provided with a throttle valve 7 for regulating the amount of intake air reaching the combustion chamber 2. The intake manifold is further provided with an air flow meter 16, disposed before, or upstream of, the throttle valve 7, for detecting the amount of intake air, i.e., the rate at which intake air flows into the intake manifold 5 and providing an output signal representative of the amount of intake air detected thereby. The intake manifold 5 is formed with a bypass passage 10 with an electromagnetically actuated idle speed control valve 11, which is well known in the art and typically referred to as an "ISC valve," to allow and regulate the flow of intake air therethrough. The intake air flowing through the bypass passage 10 bypasses the throttle valve 7, as to supply supplementary intake air into the intake manifold 5 downstream of the throttle valve 7.

The exhaust manifold 6, connecting the combustion chamber 2 to a catalytic converter 9 for significantly lowering emission levels of hydrocarbons, carbon monoxide, and in the cases of me converters, oxides of nitrogen, as is well known in the art, is provided with an oxygen sensor 21 near the exhaust port 36 to detect oxygen and produce an appropriate output signal representative of the oxygen content of the emissions detected thereby.

A fuel injector 8, of a type which is pulsed to open, is disposed adjacent to the intake port 35 and is controlled to inject a regulated amount of fuel into the combustion chamber 2 by a controller 28 with a central processing unit (CPU) incorporated therein. To provide the fuel injector 8 with a control signal, the controller 28 receives various signals from various sensors and switches 15, 17, 18, 19, 20, 22, 23, 24 and 29, in addition to the air-flow meter 16 and the oxygen sensor 21. More particularly, a temperature sensor 15 is provided in the intake manifold 5 disposed just before, or upstream of the throttle valve 7 to detect the temperature of intake air and provide the controller 28 with an output signal representative of the intake air temperature detected thereby. Adjacent to the throttle valve 7 in the intake manifold 35 is an idle sensor 17 adapted and designed to close and send an appropriate output signal to the controller 28 indicating whether the throttle valve is in an idle or full throttle position. A throttle valve position sensor 18 directly cooperates with the throttle valve 7 as to detect an operated angle or opening of the throttle valve 7 and provide the controller 28 with an appropriate output signal representative of the opening detected thereby.

The cylinder block El is provided with a temperature sensor 19 disposed in a water jacket E12 to detect the temperature of engine coolant and provide the controller 28 with an output signal representative of the engine coolant temperature detected thereby. The cylinder block El is further provided with a knock sensor 20 to detect knocking of the engine E and send an appropriate output signal to the controller 28 indicating the level of engine knocking detected thereby. Provided in association with the engine E are an speed sensor 22 to for detecting the speed of a vehicle on which the engine E is mounted and sending an output signal representative of the vehicle speed detected thereby to the controller 28, and a load sensor 23 adapted and designed to switch on and send an appropriate output signal to the controller indicating whether a power steering system or an air conditioning system is in operation. An atmospheric pressure sensor 24 is provided to detect the atmospheric pressure and provide the controller 28 with an output signal representative of the atmospheric pressure detected thereby. The engine E is further provided with a switch 29, such as an ON-OFF switch adapted to provide, or not provide, a signal only when being attached to an automatic transmission. The controller 28 judges if a transmission installed in or coupled to the engine E is, for example, automatic in the presence of the signal or manual in the absence of the signal. The switch 29 may be replaced any means adapted to indicate the type of transmissions installed in or coupled to the engine E, namely automatic and manual, by the presence and absence of a signal. All of the meters, senors and switches 15 through 24 and 29 may be of any type well known in the art.

The controller 28, based on the signals provided by the meters, sensors and switches 15 through 23 and 29 and following a program stored in a memory, such as a ROM, thereof, controls operations of the fuel injector 8 and ISC valve 11. The controller 28 stores data and maps of engine operating zones, previously established according to design considerations of the engine E, in a memory, such as a RAM, thereof, for various operation modes of what are termed, in this specification, "delayed fuel injection control" selectively used in association with the types of transmissions, such as a manual transmission and an automatic transmission. For example, the engine operating zone map shown in FIG. 5 is selectively used for the engine E provided with a manual transmission; while the engine operating zone map shown in FIG. 6 is selectively used for the engine E provided with an automatic transmission.

Figure 5:
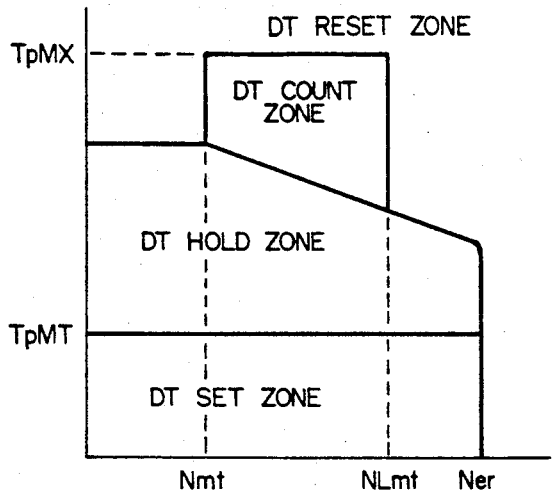
FIGS. 5 and 6 are diagrams showing ordinary delay time control patterns for an engine equipped with a manual transmission and an engine equipped with an automatic transmission, respectively.
Figure 6:
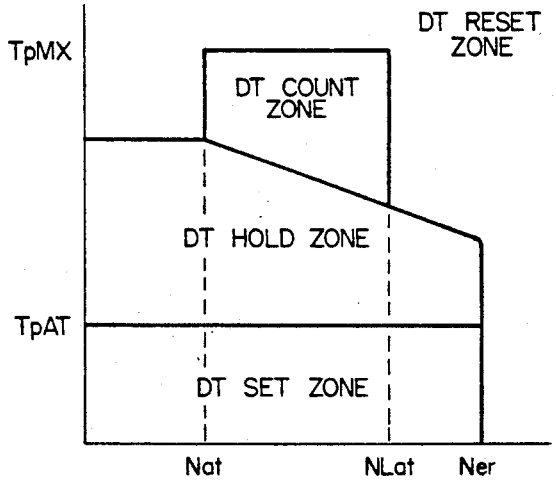
Figure 7:
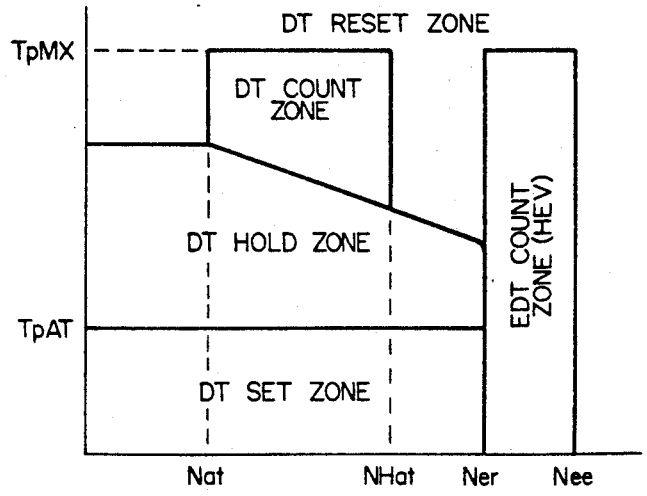
FIG. 7 is a diagram, similar to FIG. 6, showing a delay time control pattern for an engine equipped with an automatic transmission, in which an expanded or additional specific delay time count zone is provided.

Because both of the engine operating condition zone maps shown in FIGS. 5 and 6 are the same as each other in pattern excepting that upper and lower critical engine speeds, by which the various engine operating zones are defined, are different as, between the two, the following description is made in conjunction with the map shown in FIG. 5 only. The engine operating zone map has four zones, namely a delay time set zone (DT set zone) referred to the fact that a delay time (DT) with which fuel increase control is conducted is set in the zone; a delay time count zone (DT count zone) referred to the fact that the fuel increase control is effected after the delay time has counted up; a delay time reset zone (DT reset zone) referred to the fact that the delay time is cancelled as to effect the fuel increase control immediately after the engine operating condition has entered the zone; and a delay time hold zone (DT hold zone) referred to the fact that counting the delay time is temporarily suspended and the counted value thereby is maintained at a transition of the engine operating condition into the zone from the delay time count zone.

Figures 2, 2A:
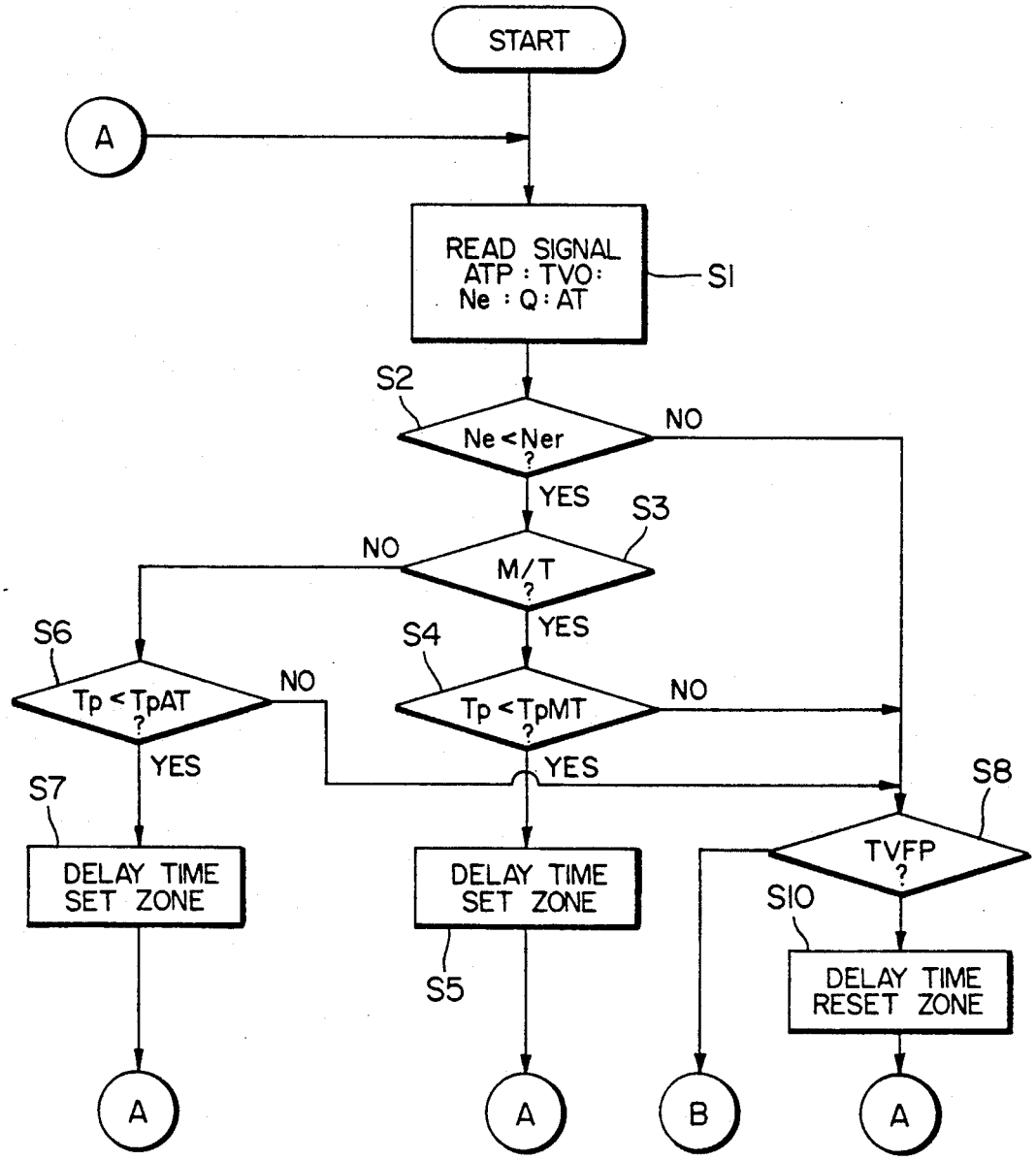
FIG. 2 which is split into FIG. 2A and FIG. 2B for ease of illustration is a flow chart illustrating a fuel increase control routine.
Figure 2B:
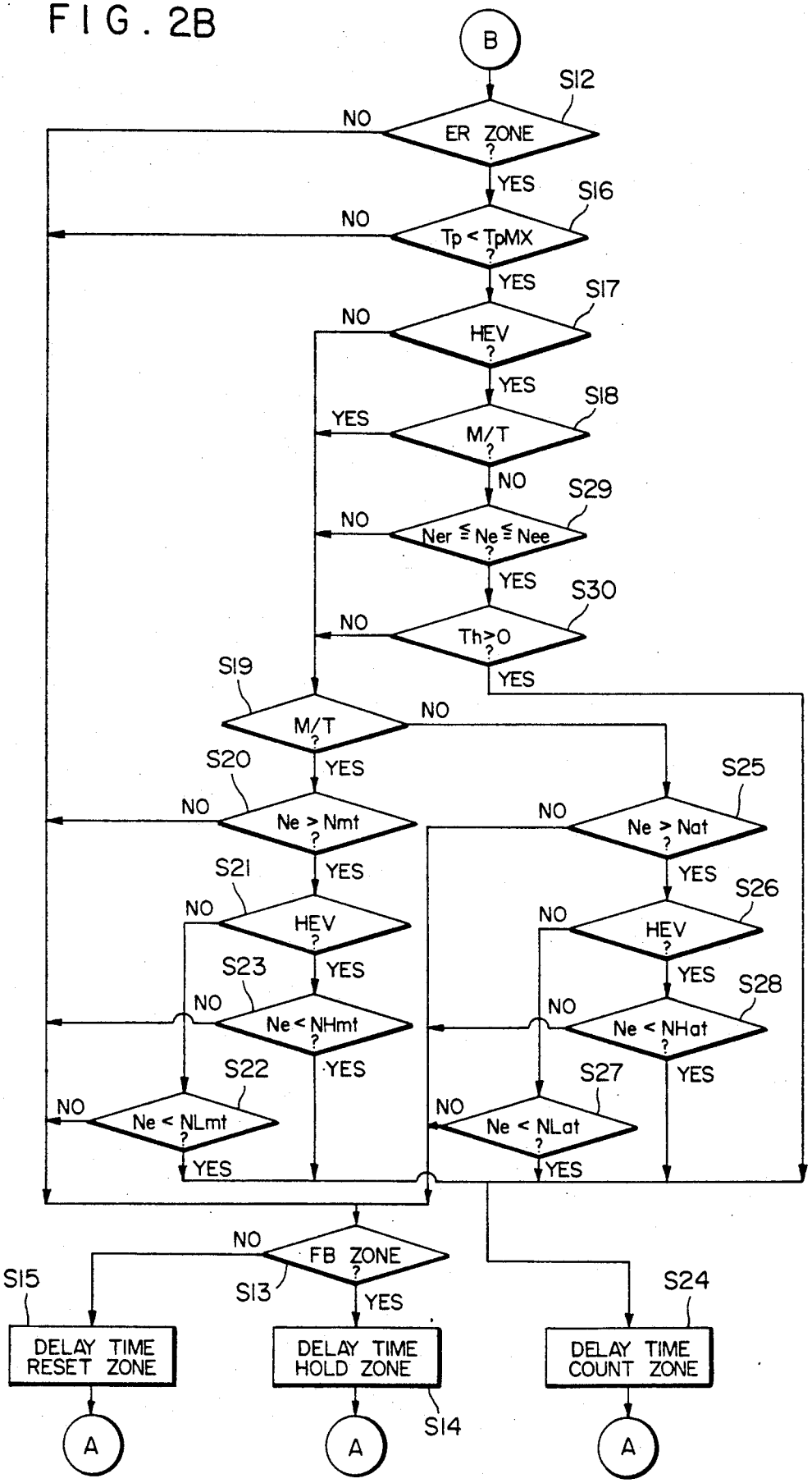
Figure 3:
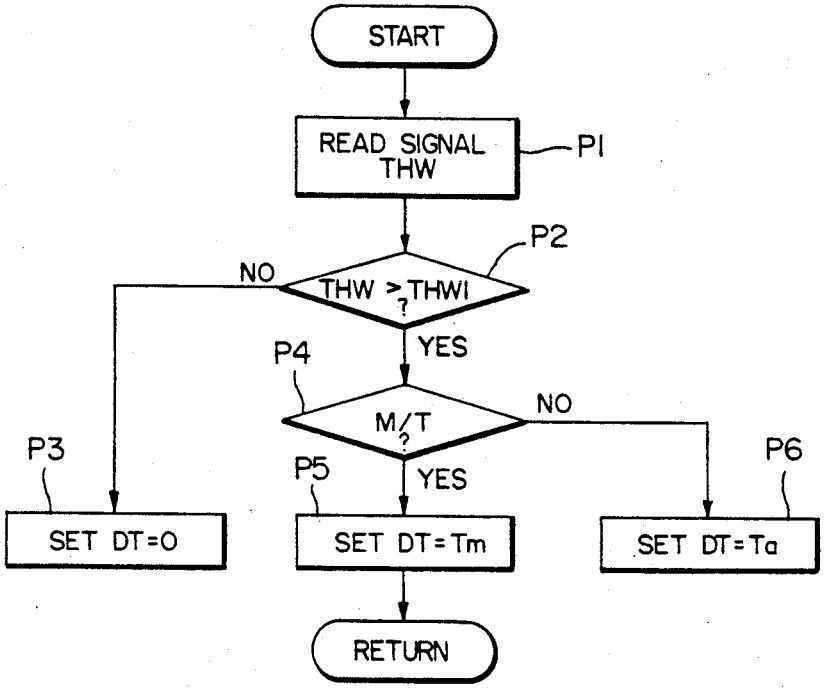
FIG. 3 is a flow chart illustrating a delay time setting routine.
Figure 4:
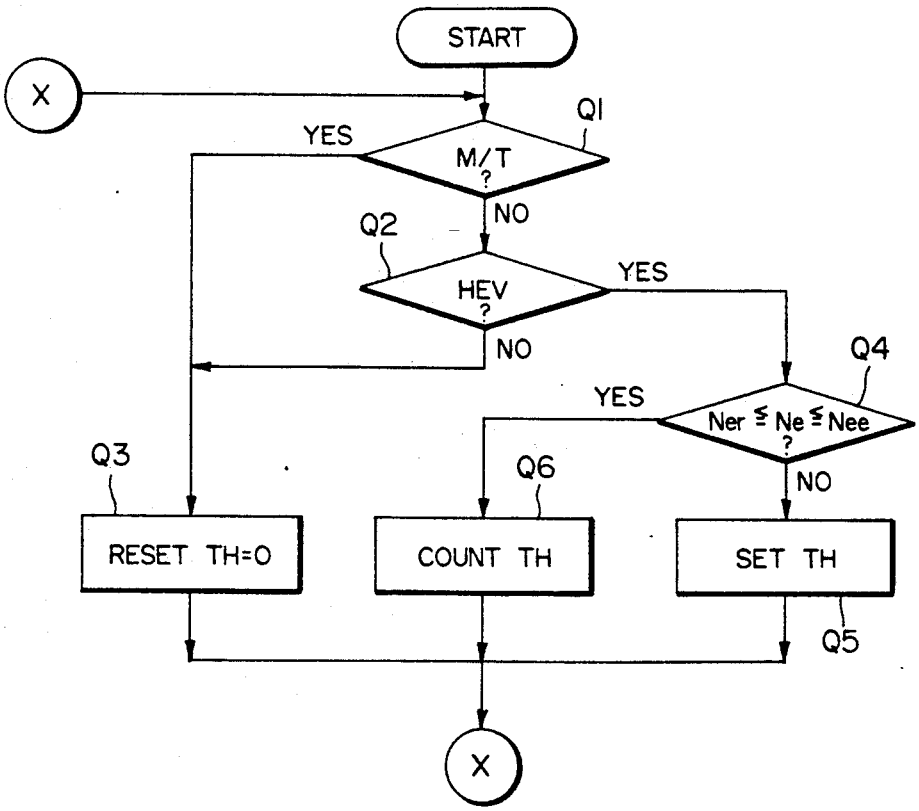
FIG. 4 is a flow chart illustrating a timer setting routine.

The operation of the fuel injection control system for the internal combustion engine illustrated in FIG. 1 will be best understood by reviewing FIGS. 2 to 4, which are flow charts illustrating various routines for the microcomputer of the controller. Programming a microcomputer is a skill well understood in the art. The following description is written to enable a programmer having ordinary skill in the art to prepare an appropriate program for the microcomputer. The particular details of any such program would of course depend upon the architecture of the particular microcomputer selected.

Referring to FIG. 2, which is a flow chart illustrating the fuel increase control routine, in a first step S1, the controller 28 reads signals, representative of the atmospheric pressure ATP, the opening TVO of the throttle valve 7, the speed of rotation Ne of the engine E and the amount of intake air Q from the atmospheric pressure sensor 24, the throttle valve position sensor 18, the distributor 14 and the air-flow meter 16, respectively. The controller 28 compares the speed of rotation Ne of the engine E with a critical engine speed Ner, for example about 4,700 rpm., for defining a delayed fuel increase control zone, including the delay time set, hold and count zones, in which the delayed fuel increase control is to be conducted. If the engine speed Ne is lower than the critical engine speed Ner ($Ne<Ner$), the controller 28 switches to step S3 to judge if the transmission installed in the engine E is manual according to the presence or absence of a signal from the switch 29. If there is an absence of the signal from the switch 29 or the answer to the decision is yes, this indicates that a manual transmission (M/T) is installed in or coupled to the engine E, then, the controller switches to step S4 to compare an engine load Tp with a lower critical engine load TpMT presumably established for defining an upper limit of engine load of the delay time set zone (DT set zone), depicted in FIG. 5, which is provided for the engine E equipped with the manual transmission. The engine load Tp is obtained depending upon the engine speed Ne and the amount of intake air Q read at step S1. If in fact the engine load Tp is lower than the upper critical engine load TpMT, the controller 28 judges, at step S5, that the on-going engine operating condition is in the delay time set zone (DT set zone).

If there is the presence of a signal from the switch 29 or the answer regarding to the type of transmission is no, this indicates that an automatic transmission (A/T) is installed in or coupled to the engine E, then, the controller switches to step S6 to compare the engine load Tp with a lower critical engine load TpAT presumably established for defining an upper limit engine load of the delay time set zone (DT set zone), depicted in FIG. 6, which is provided for the engine E equipped with the automatic transmission. If in fact the engine load Tp is lower than the lower critical engine load TpMT, the controller 28 judges, at step S7, that the on-going engine operating condition is in the delay time set zone (DT set zone).

Setting a delay time DT for the delayed fuel increase control is performed following the sequence shown in FIG. 3. That is, the controller 28, after reading a signal representative of the temperature THW of cooling water in the water jacket E12 from the temperature sensor 19 at step Pl, makes a decision at step P2 if the temperature THW is equal to or higher than a critical temperature presumably established for setting the delay time DT. If the answer to the decision is no, the controller 28 switches to step P3 to set the delay time DT to zero (0). On the other hand, if the answer to the decision at step P2 is yes, then, the controller 28 switches to step P4 to judge if a manual transmission is installed in or coupled to the engine E. If in fact the engine E is equipped with a manual transmission, the controller 28 switches to step P5 to set the delay time DT to a time Tm. However, If the engine E is equipped with an automatic transmission, the controller 28 switches to step P6 to set the delay time DT to a time Ta. It should be noted that the time Ta is established to be longer than the time Tm.

If the answer to either one of the decisions at steps S2 and S4 is no, this indicates that the engine speed Ne is not lower than the critical speed Ner. Then, the controller 28 switches to step S8 to judge, based on a signal representative of the detected opening of the throttle valve 7 by the throttle valve position sensor 18, if the throttle valve 7 is fully opened. If in fact the throttle valve 7 has been fully opened, which is indicated by TVFP in FIG. 2A, the controller 28, after resetting the delay time DT to zero (0), orders return to step S1. Steps S1 to S10 are repeated as long as the throttle valve 7 opens to its full position.

On the other hand, if the answer to the decision at step S8 is no, indicating that the throttle valve has not been opened to the full position, then, the controller 28 switches to step S12 to make a decision as to whether the engine operating condition is in an enrich zone (ER zone). If not in the enrich zone (ER zone), the controller 28 switches to step S13 to make a decision if the air-fuel ratio of the fuel mixture is in the feedback (FB) range wherein a feedback fuel control is to be conducted in a well known manner. The controller 28 judges, at step S14 if in the feedback range, that the on-going engine operating condition is in the delay time reset zone (DT reset zone) or, at step S15 if not in the feedback range, that the on-going engine operating condition is in the delay time hold zone (DT hold zone).

If the answer to the decision regarding the enrich zone (ER zone) is yes, the controller 28 switches to step S16 to compare the engine load Tp with an upper critical engine load TpMX presumably established for defining an upper limit engine load of the delay time count zone, depicted in FIG. 5, which is provided for the engine E equipped with a manual transmission or an upper critical engine load TpAX presumably established for defining an upper limit engine load of the delay time count zone, depicted in FIG. 6, which is provided for the engine E equipped with an automatic transmission. If the engine load Tp is lower than the upper critical engine load TpMX or TpAX, the controller 28 further makes a decision regarding the time delay count zone (DT count zone). For this decision, the controller 28 first makes a decision, at step S17, based on a signal representative of the atmospheric pressure from the atmospheric pressure sensor 24, if the engine E operates at high elevations (HEV) higher than a predetermined critical elevation, for example, of about 1000 m, and then a decision, at step S18, if a manual transmission (M/T) is installed. If, the answers to the decisions at steps S16 and S17 indicate that the engine E is provided with an automatic transmission and operates at a high elevation, the controller 28 undergoes steps to expand the time delay count zone or provide an additional time delay count zone, which is hereinafter referred to as an expanded time delay count zone (EDT count zone), to the side of higher engine speeds, i.e., between the critical engine speed Ner and a critical engine speed Nee, for example about 5,500 rpm., as will be described in detail later.

However, if the engine E operates at an elevation lower than the predetermined critical elevation, or if the engine E is provided with a manual transmission (M/T) and operates at an elevation lower than the predetermined critical elevation, the controller 28 switches to step S19 in order to control the engine E to operate in the time delay count zone (DT set zone). That is, at step S19, the transmission is judged again to determine if it is manual. If in fact a manual transmission is detected, the controller 28 switches to step S20 to compare the engine speed Ne with a lower critical engine speed Nmt presumably established for defining an lower limit of engine speed of the delay time count zone, depicted in FIG. 5, for the engine E equipped with a manual transmission (M/T). If the answer to the decision indicates that the engine speed Ne is higher than the lower critical engine speed Nmt, then, the controller 28 again makes a decision regarding high elevation (HEV) at step S21 and compares, at step S23, if at a high elevation, the engine speed Ne with a higher critical engine speed NHmt presumably established for defining a higher limit of engine speed of the delay time count zone for high elevations (HEV) for the engine E equipped with a manual transmission. On the other hand, if the engine E operates at an elevation lower than the predetermined critical elevation, then, the controller 28 compares, at step S22, the engine speed Ne with a higher critical engine speed NLmt of, for instance, about 4,000 rpm. presumably established for defining a higher limit of engine speed of the delay time count zone for the low elevations, depicted in FIG. 5, for the engine E equipped with a manual transmission.

If the engine speed Ne is lower than the higher critical engine speed NHmt or NLmt, the controller 28 decides, at step S24, that the engine operating condition is in the delay time count zone.

If any one of the answers to the decisions at steps S12, S16, and S20 through S23 is no, the controller 28 switches to step S13 to make the decision regarding the feedback (FB) range in order to determine the on-going engine operating condition to be in the delay time reset zone (DT reset zone) or in the delay time hold zone (DT hold zone).

If the answer to the decision regarding the type of transmission, i.e. manual transmission M/T, is no, this indicates that the transmission of the engine E is automatic, then, the controller 28 switches to step S25 to compare the engine speed Ne with a lower critical engine speed Nat presumably established for defining a lower limit of engine speed of the delay time count zone, depicted in FIG. 6, for the engine E equipped with an automatic transmission. If the answer to the decision in step S25 is yes, indicating that the engine speed Ne is higher than the lower critical engine speed Nat, then, the controller 28 again makes a decision regarding high elevation (HEV) at step S26 and compares, at step S28, if the engine is at a high elevation, the engine speed Ne with a higher critical engine speed NHat presumably established for defining a higher limit of engine speed of the delay time count zone for high elevations, for the engine E equipped with an automatic transmission. On the other hand, if the engine E operates at an elevation lower than the predetermined critical elevation, then, the controller 28 compares, at step S27, the engine speed Ne with a higher critical engine speed NLat of, for example, about 4,500 rpm. presumably established for defining a higher limit of engine speed of the delay time count zone for low elevations, depicted in FIG. 6, for the engine E equipped with an automatic transmission. If the engine speed Ne is lower than the higher critical engine speed NHat or NLat, the controller 28 decides, at step S24, that the engine operating condition is in the delay time count zone (DT count zone).

Returning to step S18, if the answers to the decisions at steps S16 and S17 indicate that the engine E operates at a high elevation (HEV) and is provided with an automatic transmission (A/T), the controller 28 makes a decision at step S29 whether the engine speed Ne is between the critical engine speeds Ner and Nee, for example 4,700 rpm. and 5,500 rpm., respectively, for defining an expanded delay time count zone (EDT count zone). If in fact the engine speed Ne is between the critical engine speed Ner and Nee for defining the expanded delay time count zone (EDT count zone) therebetween, the controller 28 makes a decision at step S30 whether a value Th of a high elevation delay timer T, counted down from an initial set value TH, is not zero (0). The initial count value TH which is established to be shorter than the delay time DT, having been used in the ordinary delay time count zone (DT count zone), and which the high elevation delay timer T is set to in such a way, is shown in FIG. 4 illustrating a high elevation delay time count routine. That is, the controller 28 makes decisions regarding the type of transmission and elevations at step Q1 and Q2 in order. If the transmission of the engine E is manual or if the engine E is equipped with an automatic transmission and operates at a low elevation, the high elevation delay timer T is reset to zero (0) at step Q3. However, if the engine E is equipped with an automatic transmission and operates at a high elevation, then, the controller 28 switches to step Q4 to make a decision whether the engine speed Ne is between the critical engine speed Ner and Nee for defining the expanded delay time count zone (EDT count zone) therebetween. Finally, the controller 28 sets the high elevation delay timer T to the initial count value TH, if out of the range between the critical engine speed Ner and Nee, at step Q5 or counts down a latest value Th of the high elevation delay timer T, at step Q6, every time if in the speed range between the critical engine speeds Ner and Nee.

Until the value Th of the high elevation delay timer T becomes zero (0), the controller 28 decides, at step S24, that the engine operating condition is in the delay time count zone (DT count zone). In cases where the elevation is low, where the transmission of the engine E is manual, where the engine speed Ne is out of the range between the critical engine speeds Ner and Nee or where the high elevation delay timer T has counted down the initial count value TH, the controller 28 undergoes steps S19 through S27 as to decide that the engine operating condition is in the delay time hold zone (DT hold zone), the delay time reset zone (DT set zone) or the delay time count zone (DT count zone), as described above. Any final decision of fuel delay time, at step S5, S7, S14, S15 or S24, orders return to the first step S1 as to repeat the sequence.

It should be noted in the above description that the higher and lower critical engine speeds NLmt and Nmt are established to be lower than the higher and lower critical engine speeds NLat and Nat, respectively, and that the higher critical engine speeds NLmt and NLat are lower than the higher critical engine speeds NHmt and NHat, respectively. It should al be noted that each of the engine loads Tp, TpMX, TpAT and TpMT may be, if desired, given in the form of a pulse width by which the amount of fuel to be delivered from the injector 8 is defined.

As apparent from the above, if the engine E is equipped with a manual transmission, the controller 28 performs the fuel increasing control only after the lapse of a delay time DT while the engine E operates at an engine operating condition falling in the delay time count zone defined by the upper critical engine load TpAX and the upper and lower critical engine speeds NLmt and Nmt. The fuel injection control system, even if the engine changes the operating condition into the delay time hold zone or the delay time set zone immediately after falling in the delay time count zone for a short time period, temporarily suspends an increase in fuel amount, that there is no chance that fuel increase control is undesirable effected.

In addition, the fuel injection control system, when the engine E is equipped with the automatic transmission, and operates at high elevations, provides the expanded delay time count zone (EDT count zone) defined between the critical engine speeds Ner and Nee and below the upper critical engine load TpMX, in addition to the delay time count zone (DT count zone). Thus, although drivers, while operating the engine E at high elevations, have a tendency to deeply depress the accelerator pedal in an attempt at increasing the engine speed higher than as usual due to slippage of the torque converter and an decrease in intake air amount and accordingly, the engine operating condition changes to high engine loads without falling in the ordinary delay time count zone (DT count zone), the fuel injection control system of this invention temporarily suspends the fuel increase control as long as the engine operating condition returns to a zone of low engine loads and low engine speeds after remaining in the expanded delay time count zone (EDT count zone) for a short time period, that the fuel increase control is not undesirably conducted.

Furthermore, because the engine operating condition falls in the expanded delay time count zone (EDT count zone), the fuel increase control is not undesirably conducted even when the automatic transmission increases its gear ratio due to kick down or shift down and thereby increases the engine speed.

It should be understood that the expanded delay time count zone in which the fuel increase control is conducted with a delay time may be, if desired, provided when the engine E equipped with the automatic transmission operates at low elevations, in addition to high elevations.

It should al be understood that although the invention has been described in detail with respect to a specific embodiment thereof, nevertheless, various other embodiment and variants are possible which are within the spirit and scope of the invention, such other embodiment and variants are intended to be covered by the following claims.

What is claimed is:

1. A fuel injection control system for an internal combustion engine equipped with one of a manual and an automatic transmission, said internal combustion engine being delivered different amounts of fuel by fuel injection means according to engine operating conditions, said fuel injection control system comprising:

fuel increasing means for causing said fuel injection means to increase the amount of fuel delivered to the engine when the engine operates in a specific zone of engine operating conditions defined at least by engine speed;

engine operating condition detecting means for detecting a condition in which the engine operates;

control means for forcing, when said engine operating condition detecting means detects said condition remaining in said specific zone, said fuel increasing means to make said increase in the amount of fuel with a predetermined time delay from a time said condition changes into said specific zone;

transmission judging means for judging a transmission in use with said internal combustion engine to be manual or automatic; and zone expanding means for expanding said specific zone when said transmission judging means judges said transmission in use with said internal combustion engine to be automatic that said fuel increasing means, when said internal combustion engine operates in an expanded part of said specific zone, causes said fuel injection means to make said increase in the amount of fuel.

2. A fuel injection control system as defined in claim 1, wherein said expanded part of said specific zone is created at engine speeds higher than an engine speed by which an upper limit of said specific zone is defined.

3. A fuel injection control system as defined in claim 2, wherein said predetermined delay time is shorter in said specific zone than in said expanded part of said specific zone.

4. A fuel injection control system as defined in claim 3, wherein said predetermined delay time is longer for the engine when equipped with an automatic transmission than for the engine when equipped with a manual transmission.

5. A fuel injection control system as defined in claim 3, wherein said predetermined delay time is cancelled when the engine has been warmed up to a desired temperature.

6. A fuel injection control system as defined in claim 3, further comprising elevation detecting means for detecting an elevation at which the engine operates, and said zone expanding means being operated when said elevation detecting means detects an elevation higher than a predetermined elevation.

7. A fuel injection control system as defined in claim 6, wherein said expanded part of said specific range is created over engine loads on said side of engine speeds higher than an engine speed by which an upper limit of said specific zone is defined.

8. A fuel injection control system as defined in claim 6, wherein said elevation detecting means is an atmospheric pressure sensor.

9. A fuel injection control system as defined in claim 3, wherein said specific zone of engine operating condition is further defined by engine loads.

10. A fuel injection control system as defined in claim 9, wherein a counted down value of said predetermined delay time in said specific zone is held when said condition moves from said specific zone into a delay time hold range of engine loads below said specific zone.

11. A fuel injection control system as defined in claim 10, wherein said predetermined delay time is effectively set when said condition falls in a delay time set zone of engine loads below said delay time hold zone.

12. A fuel injection control system as defined in claim 3, wherein said transmission judging means comprises signal means which is made effective only when an automatic transmission is connected to said engine as to provide a signal representing that a transmission for use with the engine is an automatic transmission.

13. A fuel injection control system as defined in claim 12, wherein said signal means is a manually operable switch.

14. A fuel injection control system as defined in claim 12, wherein said signal means is a switch automatically operated by connecting said automatic transmission to said engine.

* * * * *